United States Patent [19]

Hummer

[11] Patent Number: 4,817,807

[45] Date of Patent: Apr. 4, 1989

[54] TAMPER-EVIDENT CONTAINER

[76] Inventor: L. Leroy Hummer, P.O. Box 19692, Alexandria, Va. 22320

[21] Appl. No.: 74,075

[22] Filed: Jun. 23, 1987

Related U.S. Application Data

[63] Continuation-in-part of Ser. No. 881,208, Jul. 1, 1986, abandoned.

[51] Int. Cl.[4] ..... B65D 41/48

[52] U.S. Cl. ..... 215/253

[58] Field of Search ..... 215/250, 251, 253, 321, 215/274, 254; 220/257, 258

[56] References Cited

U.S. PATENT DOCUMENTS

| | | | |
|---|---|---|---|
| 3,044,651 | 7/1962 | Friedman | 215/31 |
| 3,061,131 | 10/1962 | Robinson | 215/321 |
| 3,414,183 | 12/1968 | Wilcox | 215/321 X |
| 3,459,315 | 8/1969 | Labarre | 215/253 X |
| 3,715,063 | 2/1973 | Susuki et al. | 215/321 X |
| 3,812,992 | 5/1974 | Wolf et al. | 215/253 |
| 3,913,771 | 10/1975 | Acton et al. | 215/274 X |
| 3,960,287 | 6/1976 | Baker | 215/253 |
| 4,558,794 | 12/1985 | Towns et al. | 215/250 |

FOREIGN PATENT DOCUMENTS

| | | | |
|---|---|---|---|
| 2524426 | 10/1983 | France | 215/253 |
| 695086 | 8/1953 | United Kingdom | 215/250 |

*Primary Examiner*—Donald F. Norton

*Attorney, Agent, or Firm*—Berman, Aisenberg & Platt

[57] ABSTRACT

An adaptor includes a cap and seal and may be easily attached to a container after contents have ben placed in the container. The adaptor includes a seal on its bottom surface which is pinned between that bottom and an upper edge of the sidewall of the container after assembly. This provides a seal which cannot be replaced after opening the container. A second seal covers the first seal to provide additional air-tightness during shipping. The adaptor is securely attached to the container, and those locations at which one could pry the adaptor from the container are provided with tamper-evident features.

25 Claims, 2 Drawing Sheets

TAMPER-EVIDENT CONTAINER

This is a continuation-in-part of U.S. application 881,208 filed July 1, 1986, now abandoned.

TECHNICAL FIELD

This invention relates to the art of containers. In particular, the invention is a container and an adaptor for being attached to the container.

BACKGROUND ART

The art of containers is very crowded, and many attempts have been made to provide an inexpensively manufactured container which will fulfill several criteria. For example, when a container and closure are used for a material which is to be consumed, it is necessary to provide clear tamper-evident features. At the same time, these features must be easily incorporated into the structure of the container concept to reduce manufacturing costs and facilitate use by the consumer.

U.S. Pat. No. 4,560,076 (Boik) teaches a container having a tamper-indicating mechanism attached to the closure. When the cap is moved, a tamper band is automatically separated from the cap to provide evidence that the cap has been previously opened.

U.S. Pat. Nos. 4,030,630 (Yealy); 3,135,441 (Wise et al.); and 2,383,274 (Punte) show various containers wherein a disc-like seal may be pulled away by grasping a tab to open the container.

SUMMARY OF THE INVENTION

The containers in the prior art do not provide adequate or tamper-proof features at a reasonable cost. While many different mechanisms have been designed to provide tamper-evidence, they have been either complex, and consequently expensive, or inadequate.

In accordance with the invention, a container is designed to receive an adaptor, wherein the adaptor carries the seal or seals for the container. The container is easily molded and may be filled with pills, or the like, in a normal assembly line process. Then, the adaptor containing the seal or seals and a removable cap is simply attached to the container.

The container includes features for engaging the adaptor and retaining it. The container has ridges which extend outwardly from an upper portion of the sidewall of the container to engage corresponding ridges extending inwardly from a skirt on the adaptor. A horizontally extending surface is located above the ridges on the sidewall of the container, and this surface is engaged by hook-like elements depending from the adaptor.

In a first embodiment, the adaptor includes a lower wall having an opening therein and a seal on the bottom surface of the wall covering the opening. When the adaptor is placed on the container, this seal is pinned between the bottom wall of the adaptor and the upper edge of the container. A second seal is located on the upper surface of the bottom wall of the adaptor also to cover the opening.

Because the first seal is pinned between the bottom wall of the adaptor and the upper edge of the container, it cannot be removed and surreptitiously replaced without removing the adaptor and reattaching it to the container. The features holding the adaptor to the container prevent removal of the adaptor in the absence of a force which will clearly deform the adaptor and provide evidence of tampering.

In a second embodiment, the seal is integrally molded with the lower wall of the adaptor, and the neck of the container engages the bottom surface of the wall directly. The height of the neck is such that a force is applied to the lower wall of the adaptor to prevent reattachment of the lower wall should it be removed during tampering.

In the second embodiment, a collar extends downwardly from the lower wall of the adaptor to cover the inner surface of the neck of the container. A second, thin protrusion also extends downwardly from the lower wall of the adaptor to engage the neck of the container to form an air-tight seal.

A second embodiment also includes designed weaknesses in the skirt of the adaptor so that it cannot be pried off without tampering being evident. Another design weakness is provided just below the shoulder of the container so that the top of the container will break off if excessive force is applied during attempted removal of the adaptor.

An object of this invention is to provide a container, adaptor, and closure which are economical to produce and assemble.

Another object of this invention is to provide a container and adaptor having tamper-evident features which is not expensive to manufacture.

DETAILED DESCRIPTION OF THE PREFERRED EMBODIMENTS

Figure 1:
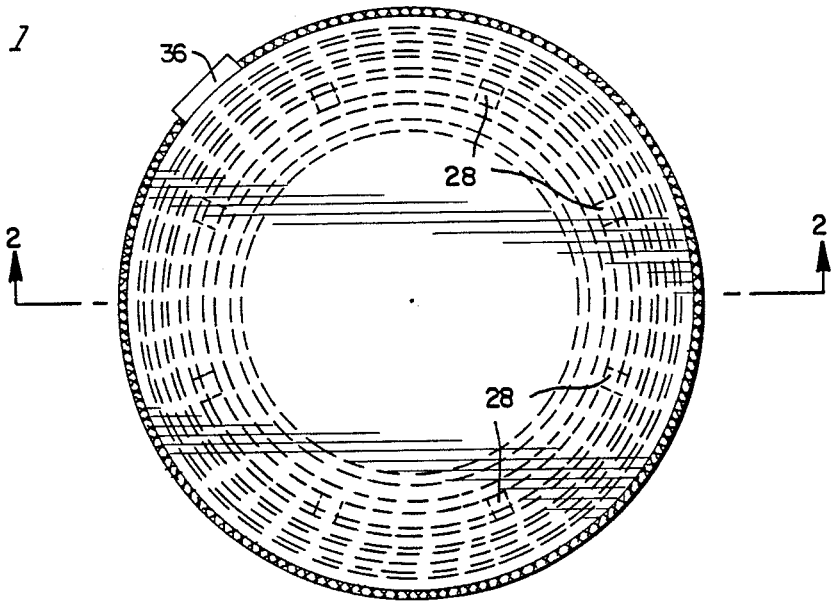
FIG. 1 is a top view of a container in accordance with the invention.
Figure 2:
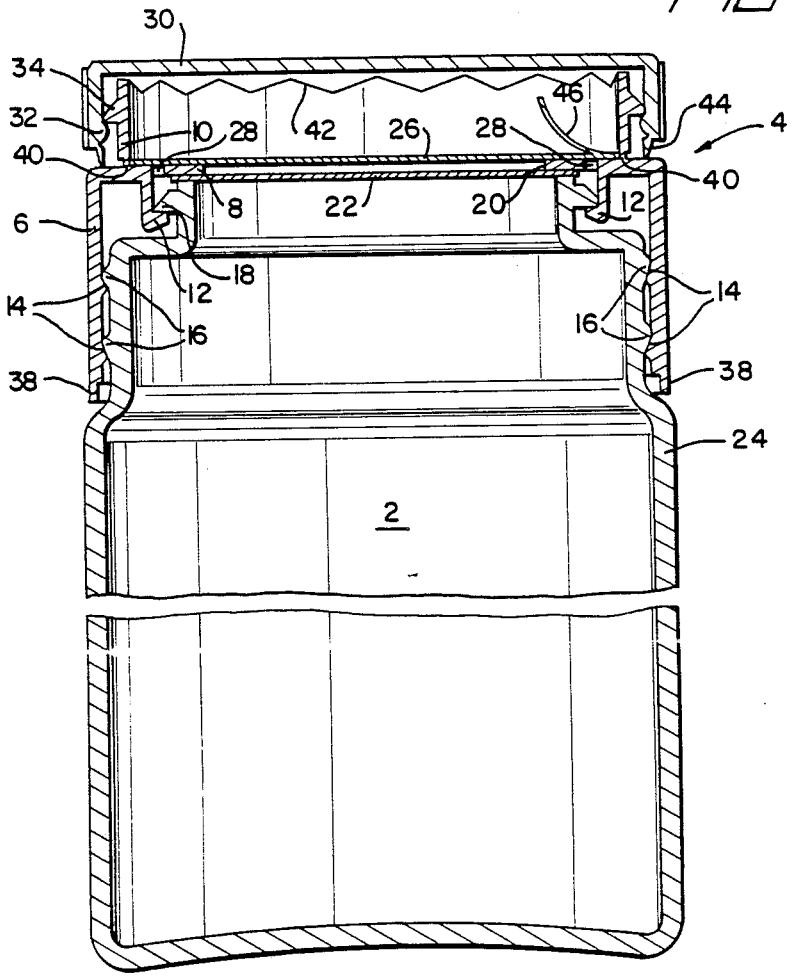
FIG. 2 is a longitudinal cross-section taken along line 2—2 of FIG. 1.

With reference to FIGS. 1 and 2, a container or receptacle 2 has an adaptor 4 secured to it to close the container. As will be appreciated more fully below, adaptor 4 is secured to container 2 after the desired contents have been placed in the container.

Adaptor 4 comprises a skirt 6, a bottom wall 8, a neck 10, and a latch 12. Skirt 6 has inwardly-extending ridges 14 which cooperate with outwardly extending ridges 16 on the sidewall of container 2. The engagement between ridges 14 and 16 prevents the adaptor from being removed after the adaptor has been pressed onto the container. In addition this engagement provides a double air seal. To prevent rotation of adaptor 4 with respect to container 2 and reduce the possibility of removal of adaptor 4 after assembly, mating surfaces of ridges 14 and 16 are preferably sloped about 10° with respect to the longitudinal axis of the container and striated in an upward direction.

Latch 12 depends from bottom wall 8 and engages outwardly extending lip 18 to further secure the adaptor to the container. Preferably, latch 12 comprises 4 to 8 separate pieces providing spaces to facilitate molding.

Bottom wall 8 forms opening 20 to permit the contents of the container to be dispensed. A first seal 22 is secured to a lower surface of bottom wall 8 when the adaptor is separate from the container. Then, when the adaptor is secured to the container as shown in FIG. 2, seal 22 is pinned between bottom wall 8 and an upper edge of sidewall 24 of container 2. A second seal 26 is secured to an upper surface of bottom wall 8 to provide an additional seal. Openings 28 are provided in bottom wall 8 to facilitate molding appropriate surfaces on latches 12 for engaging lips 18, and second seal 26 covers openings 28 as well as opening 20. The seals are preferably secured to wall 8 by electric induction heating.

Neck 10 is covered by a cap 30 which is secured to the neck by engagement between bead 32 and protrusion 34 as is known in the art. A finger tab 36 permits easy removal of tab 30 from neck 10. It will be appreciated that cap 30 could be secured to neck 10 by any of several child-resistant tabs, such as those which must be placed in a given angular orientation before removal. Also, screw threads may be used.

It will be appreciated from the above description that seal 22 is a tamper-evident seal. That is, to obtain access to the contents of container 2, cap 30 is removed, seal 26 is removed, and seal 22 is pierced, for example, by the user's finger. While it may be possible to replace seal 26 in such a manner that it appears not to have been previously removed, it is virtually impossible to replace seal 22 in that manner because it is pinned between bottom wall 8 and the upper edge of sidewall 24. Accordingly, seal 22 can be replaced only if adaptor 4 is removed from container 2. Applicant's preferred embodiment employs features to prevent such removal or to result in deformation of the adaptor to such an extent that removal will be evident.

The bottom edge of skirt 6 is provided with a narrow section 38. Skirt 6 is preferably made of molded plastic, and if an implement were inserted between sidewall 24 and skirt 6 in an attempt to pry adaptor 4 off container 2, section 38 would necessarily be visibly deformed. Adaptor 4 may be secured to container 2 by sonic welding, and the force required to remove the adaptor is greater than required to deform skirt section 38.

Bottomwall 8 is made thin enough that any attempt to insert a screwdriver, or the like, into opening 20 to pry off adaptor 4 will necessarily deform the bottom wall. This will clearly evidence tampering.

Neck 10 is connected to the remainder of adaptor 4 by a weak section 40. This section has enough strength for normal uses of cap 30 but will break if force is applied to protrusion 34 in an attempt to remove adaptor 4.

Thus, each place at which a tool could be inserted to remove adaptor 4 is provided with a tamper-evident feature.

Cap 30 includes flexible edge 44 which mates with a shoulder on skirt 6 to provide an air-tight seal.

The upper edge 42 of neck 10 is roughened to provide yet another tamper-evident feature. If one were to remove seals 26 and 22 he could attempt to reseal the container by placing a bogus seal on the upper edge of the neck to fool someone unfamiliar with the package and seals 22 and 26. This roughened upper edge prevents the adhering of such a seal.

Seals 22 and 26 may be of known materials such as the common foil used in present containers. Preferably, the seals are coated with polyethylene to prevent re-gluing a removed seal. Seal 26 includes a tab 46 to permit easy grasping and removal of the seal.

Figure 3:
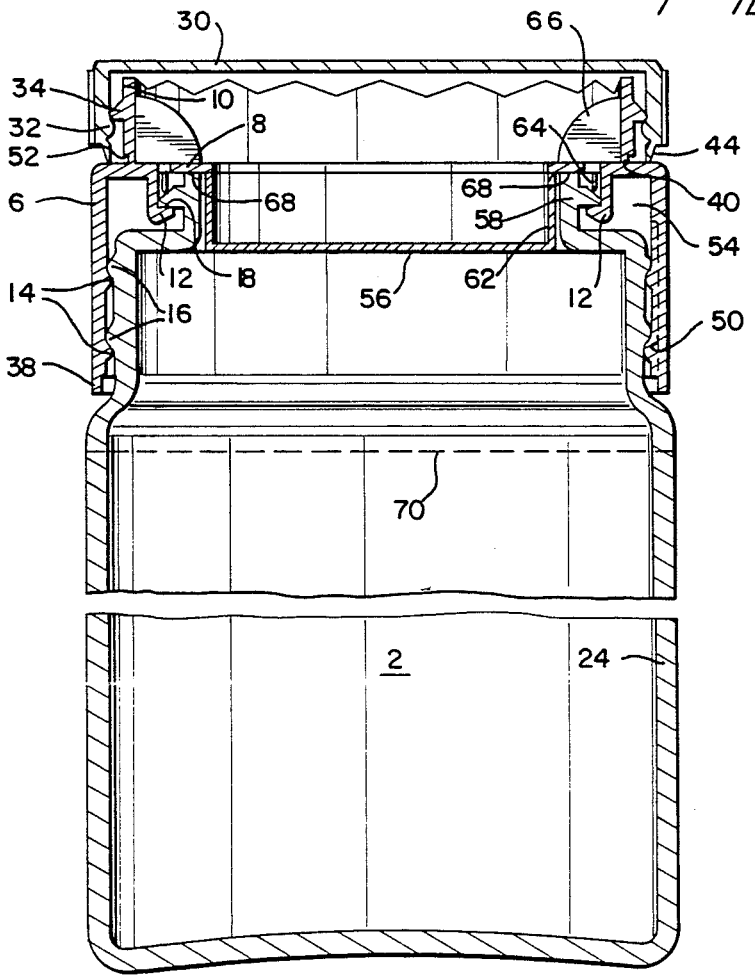
FIG. 3 is a longitudinal cross-section of a container in accordance with a second embodiment of the invention.

With reference to FIG. 3, a second embodiment of the invention will be described wherein features identical to those features described with respect to FIG. 2 have been given the same reference numerals.

Lines 50 are located on the inside wall of the adaptor 6 and are of designed weakness. These lines will crack if an attempt is made to pry the adaptor from the container, thus providing clear evidence of attempted tampering.

The designed weakness 40 securing the neck 10 to the adaptor includes incisions 52 to further weaken it without causing molding difficulties. This causes the neck 10 to easily break away from the remainder of the adaptor even if the adaptor is heated during attempted tampering.

For strengthening the latch mechanism 12, the embodiment of FIG. 3 utilizes only 4 latches which are circumferentially longer than that shown in FIG. 2. Moreover, the space between the latches 12 and the outer wall of the adaptor is filled with material 54 or gussets which allows the latches to move outwardly during attachment of the adaptor, but assists in preventing removal of the adaptor during tampering.

Figure 4:
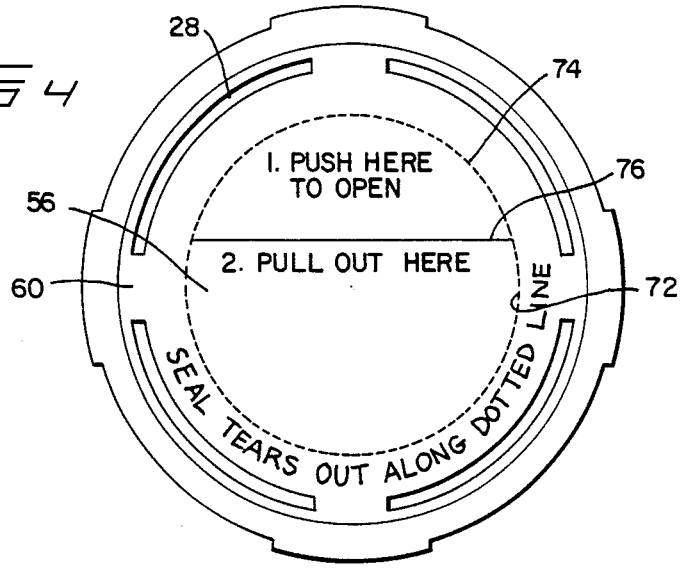
FIG. 4 is a top view of the seal portion of the second embodiment of the invention.

The two seals 22, 26 of the embodiment of FIG. 2 are replaced by a single seal 56 which is integrally molded with a collar 62 of the adaptor, as will be more fully described with respect to FIG. 4. Upper neck 58 of container 2 is lengthened so that it pushes upwardly on bottom wall 8 after the adaptor has been applied to the container. This slight lengthening of upper neck 58 beyond the nominal location of bottom wall 8 prevents reassembly of bottom wall 8 to the remainder of the adaptor should the bottom wall be cut out during tampering. It will be virtually impossible for a tamperer to apply the necessary force to replace a previously-removed bottom wall 8 without evidence of tampering. Also, the number of spokes 60 and the number of openings 28 has been reduced.

Collar 62 extends downwardly from bottom wall 8 of the adaptor, and a flexible protrusion 64 also extends downwardly from bottom wall 8 on the opposite side of neck 58. Collar 62 ensures that there is no lip between neck 58 and bottom wall 8 which could be grasped by one attempting to remove the adaptor. Flexible protrusion 64 provides an additional air-tight seal for the contents of the container.

Gussets 66 extend between bottom wall 8 and neck 10 and are aligned with spokes 60. This provides attractiveness and also reduces the ability of a tamperer to easily cut spokes 60 for removal and reattachment of bottom wall 8. The upper edge 68 of neck 58 has striations thereon which mate with striations on the bottom surface of wall 8. This prevents rotation of the adaptor with respect to the container and insures that rotation will cause damage to wall 8 to provide evidence of attempted tampering.

A line of designed weakness 70 insures that the top of the container will break off if a force is applied to the bottom of the container in an attempt to remove the adaptor.

While the cap is shown as a snap-on cap, it will be appreciated that screw threads may be provided as well.

With reference to FIG. 4, seal 56 is integrally molded with bottom 8 and includes a t-ear line 72. A portion 74 of tear line 72 is weakened more than a remaining part, and a line of weakness 76 provides for bending of seal 56. Thus, seal 56 may be easily removed by pushing on a portion of the seal adjacent line 74 and inserting one's finger through the opening caused by removal of that portion of the seal. The remainder of seal 56 is grasped from below and pulled upwardly, thus severing the remainder of tear line 72 to remove the seal.

The adaptor is preferably made of a hard or rigid material while the container is made of softer material.

It will be appreciated that a unique adaptor and container have been described which provide economical clear tamper-evident features. Modifications of the preferred embodiments within the scope of the appended claims will be apparent to those of skill and art.

I claim:

1. An adaptor for attachment to the neck of a container comprising a skirt for attachment to said container, a bottom wall extending inwardly from said skirt, latch means extending downwardly from said bottom wall for engaging a lip attached to said container for securing said adaptor to said container, said bottom wall having an inner portion with an opening therein, and a seal carried by said bottom wall covering said opening.

2. An adaptor according to claim 1 comprising a second seal covering said opening, said second seal being on a lower side of said bottom wall.

3. An adaptor according to claim 1 in combination with a said container, wherein said container comprises a sidewall forming an upper edge and said adaptor is secured to said sidewall.

4. A combination according to claim 3 wherein said container includes a sidewall having first securing means thereon engaging and retaining said skirt.

5. A combination according to claim 4 wherein said first securing means comprises a first ridge extending substantially around the perimeter of said sidewall and said skirt includes a second ridge extending substantially around the perimeter of said adaptor.

6. A combination according to claim 5 wherein mating portions of said first and second ridges are serrated.

7. A combination according to claim 5 wherein said lip extends transverse to a longitudinal axis of said container and said latch means extends transverse to said longitudinal axis and engages said lip.

8. A combination according to claim 7 wherein said lip extends outwardly from said sidewall and said latch means extends inwardly toward said lip.

9. An adaptor according to claim 1 wherein said skirt includes regions of less strength than adjacent regions so as to break during tampering.

10. An adaptor according to claim 1 further comprising means for holding a cap, wherein said means for holding a cap is connected to said adaptor by a weak connection.

11. An adaptor according to claim 1 further comprising neck means for dispensing material, said neck means having an irregular upper edge.

12. An adaptor according to claim 1 further comprising a cap covering said opening, said cap having a deformable lip for engaging a shoulder on said adaptor for providing a seal between said cap and said shoulder.

13. Apparatus comprising an adaptor and a container, said adaptor comprising a skirt for attachment to a sidewall of said container, a bottom wall extending inwardly from said skirt, latch means extending downwardly from said bottom wall for engaging a lip attached to said container securing said adaptor to said container, said adaptor comprising a collar extending downwardly from said bottom wall and covering a portion of an inner surface of said sidewall, and a removable seal attached to said collar.

14. A combination according to claim 13 wherein said adaptor further comprises a flexible protrusion extending downwardly from said first part and engaging said container sidewall.

15. A combination according to claim 14 wherein said seal is coplanar with an opening and is connected to said opening by a tearable connection.

16. A combination according to claim 15 wherein said sidewall includes a weakened portion for breaking when a removing force is applied to said adaptor.

17. Apparatus comprising a container and an adaptor, wherein said container comprises a sidewall having lip means extending outwardly therefrom, and wherein said adaptor comprises skirt means covering at least a portion of said sidewall, bottom wall means extending inwardly from said skirt means engaging a top of said sidewall of said container, latch means engaging said lip means for securing said adaptor to said container, collar means extending into to said container along said sidewall, removable seal means attached to said collar means, neck means extending upwardly from said bottom wall means and attached to said bottom wall means by a weakened connection, and a cap secured by and covering said neck.

18. Apparatus according to claim 17 wherein said cap includes a flexible lower edge engaging said bottom wall means.

19. Apparatus according to claim 18 wherein said skirt comprises elongated weakened portions extending in a direction parallel to a longitudinal axis of said container and a narrowed lower edge for indicating tampering.

20. Apparatus according to claim 19 wherein said weakened connection includes incisions therein.

21. Apparatus according to claim 20 wherein said sidewall of said container includes a line of weakness extending transverse to a longitudinal axis of said container.

22. Apparatus according to claim 21 wherein said top of said sidewall and said bottom wall include cooperating striations for preventing relative motion between said sidewall and said bottom wall.

23. Apparatus according to claim 22 wherein said seal means is connected to said collar means by a tear line, said tear line comprising first and second portions, said first portion being weaker than said second portion, said seal means further comprising a fold line between said first and second portions for permitting said seal means to be folded during removal.

24. Apparatus according to claim 17 wherein said latch means is spaced inwardly from said skirt means and further comprising material filling the space between said skirt and said latch means.

25. Apparatus according to claim 17 wherein said bottom wall means has a plurality of holes therein, each of said openings being associated with a said latch means, and further comprising a plurality of gusset means extending from locations on said bottom wall between adjacent said openings to a neck which extends upwardly from said bottom wall means.

* * * * *